United States Patent [19]

Thorson

[11] 4,343,600

[45] Aug. 10, 1982

[54] FLUID PRESSURE OPERATED PUMP OR MOTOR WITH SECONDARY VALVE MEANS FOR MINIMUM AND MAXIMUM VOLUME CHAMBERS

[75] Inventor: Clayton W. Thorson, Edina, Minn.

[73] Assignee: Eaton Corporation, Cleveland, Ohio

[21] Appl. No.: 118,264

[22] Filed: Feb. 4, 1980

[51] Int. Cl.[3] ..... F01C 1/10; F01C 21/12; F03C 2/08; F04C 2/10

[52] U.S. Cl. ..... 418/61 B; 418/189

[58] Field of Search ..... 418/61 B, 180, 189

[56] References Cited

U.S. PATENT DOCUMENTS

| | | | |
|---|---|---|---|
| 2,956,506 | 10/1960 | Brundage | 418/168 |
| 3,289,542 | 12/1966 | Fikse | 418/61 B |
| 3,473,437 | 10/1969 | Ohrberg | 418/61 B |
| 3,514,234 | 5/1970 | Albers et al. | 418/61 B |
| 3,775,031 | 11/1973 | Hansen | 418/61 B |
| 3,862,814 | 1/1975 | Swedberg | 418/61 B |

*Primary Examiner*—John J. Vrablik

*Attorney, Agent, or Firm*—C. H. Grace; L. J. Kasper

[57] ABSTRACT

A rotary fluid pressure device (11) is disclosed of the type including an internal gear set (17) wherein the toothed members (23,27) define expanding and contracting volume chambers (29). The device further includes relatively movable valve elements (19,55) having engaging valve surfaces (71,73). One of the valve elements defines fluid passages (67) communicating with the volume chambers and the other valve element defines a plurality of valve passages (63,65). There is provided a secondary valving including a fluid passage (7) defined by the first valve element and a fluid passage (77) defined by the second valve element, the secondary fluid passages being in fluid communication when the respective volume chamber is approaching its minimum volume position to prevent trapping of fluid, and as it is leaving its minimum volume position, to prevent cavitation.

10 Claims, 13 Drawing Figures

FLUID PRESSURE OPERATED PUMP OR MOTOR WITH SECONDARY VALVE MEANS FOR MINIMUM AND MAXIMUM VOLUME CHAMBERS

BACKGROUND OF THE DISCLOSURE

The present invention relates to rotary fluid pressure devices, and more particularly, to such devices which include an internal gear set and a pair of relatively movable valve members operable to communicate fluid to and from the gear set.

Although it should become apparent from the subsequent description of the invention that it may be useful with many types and configurations of rotary fluid pressure devices, including both pumps and motors, it is especially advantageous when used in a fluid motor, and will be described in connection therewith.

Also, although the invention may be used with devices having various types of internal gear sets, the invention is especially adapted for use in a device wherein the internal gear set comprises a gerotor displacement mechanism.

Fluid motors of the type utilizing a gerotor displacement mechanism to convert fluid pressure into a rotary output are especially suited for low speed, high torque applications. Typically, in fluid motors of this type, there are two relatively movable valve members. One of the valve members is stationary and provides a fluid passage communicating with each of the volume chambers of the gerotor, while the other valve member rotates, relative to the stationary valve member, at the speed of rotation of the rotatable member of the gerotor set. Valving of the type described is referred to as being "low speed" to distinguish it from the type of valving referred to as "high speed", wherein the rotatable valve member rotates at the orbiting speed of the orbiting member of the gerotor set.

One of the problems associated with fluid motors of the type described has been the operating noise level. A certain amount of noise is inevitable in such a device, but it is now believed that a noticeable amount of the noise is caused by the "trapping" of fluid in a volume chamber as it reaches its minimum volume position, and/or the "cavitation" which occurs in the volume chamber just after it passes the minimum volume position. Both of these phenomena will be described in somewhat greater detail subsequently, as they relate to fluid motors of the type to which the invention relates.

It is known in the prior art to attempt to overcome the problems of trapping and cavitation by intentionally introducing deviations from the theoretical valve timing. For example, it is known to permit the mating valve passages to remain in fluid communication for a longer time, to minimize the trapping of fluid in the volume chamber. However, this type of approach is generally considered undesirable because it substantially increases the opportunity for cross port leakage to occur, i.e., the establishment of a leakage path between the high pressure inlet fluid and the low pressure exhaust fluid. When cross port leakage occurs, the volumetric efficiency of the fluid motor is decreased.

SUMMARY OF THE INVENTION

Accordingly, it is an object of the present invention to provide a fluid pressure operated device of the type described above wherein the problems of trapping and cavitation are at least minimized, without deviating from the theoretical valve timing, or introducing various other problems such as cross port leakage, which reduces volumetric efficiency.

It is a more specific object of the present invention to provide a fluid pressure operated device which achieves the above-stated objects by means of a secondary valving arrangement which is able to communicate between the volume chamber and a source of relatively lower pressure fluid when the volume chamber reaches its minimum volume position, wherein the source of lower pressure fluid is the case area, such that the drained fluid is not "lost", but is used to lubricate the drive splines.

The above and other objects of the present invention are accomplished by the provision of an improved rotary fluid pressure device conprising a housing means defining a fluid inlet and a fluid outlet. An internal gear set is associated with the housing means and includes an internally-toothed member, and an externally-toothed member eccentrically disposed within the externally-toothed member for relative movement therebetween. The teeth of the members interengage to define expanding and contracting volume chambers during the relative movement. One of the members has rotational movement about its own axis and one of the members has orbital movement about the axis of the other member. First and second relatively movable valve elements have respective first and second slidably engaging valve surfaces. One of the valve elements is movable in synchronism with one of the movements of one of the toothed members. The first valve element defines a plurality of fluid passages in fluid communication with the expanding and contracting volume chambers and has passage openings in the first valve surface arranged circumferentially relative to the axis thereof. The second valve element defines a plurality of valve ports having openings in the second valve surface arranged circumferentially relative to the axis thereof. The plurality of valve ports includes a first group of valve ports having constant fluid communication with the fluid inlet, and a second group of valve ports having constant fluid communication with the fluid outlet. At least a portion of the first valve element passage openings are in fluid communication with at least a portion of the second valve element port openings during the relative movement to direct fluid from the fluid inlet to the expanding volume chambers, and to direct fluid from the contracting volume chambers to the fluid outlet. A secondary valve means is associated with at least one of the first and second valve elements and is operable to permit fluid communication between each of the volume chambers and a source of relatively lower pressure fluid. The permitted communication occurs as each volume chamber is at approximately its minimum volume position and fluid communication is blocked between the respective first valve element passage opening and both of the adjacent second valve element port openings.

In accordance with a more limited aspect of the present invention, the secondary valve means is also operable to permit fluid communication between each of the volume chambers and the source of relatively lower pressure fluid as each volume chamber is at approximately its maximum volume position when fluid communication is again blocked between the respective first valve element passage opening and both of the adjacent second valve element port openings.

DESCRIPTION OF THE PREFERRED EMBODIMENTS

Figure 1:
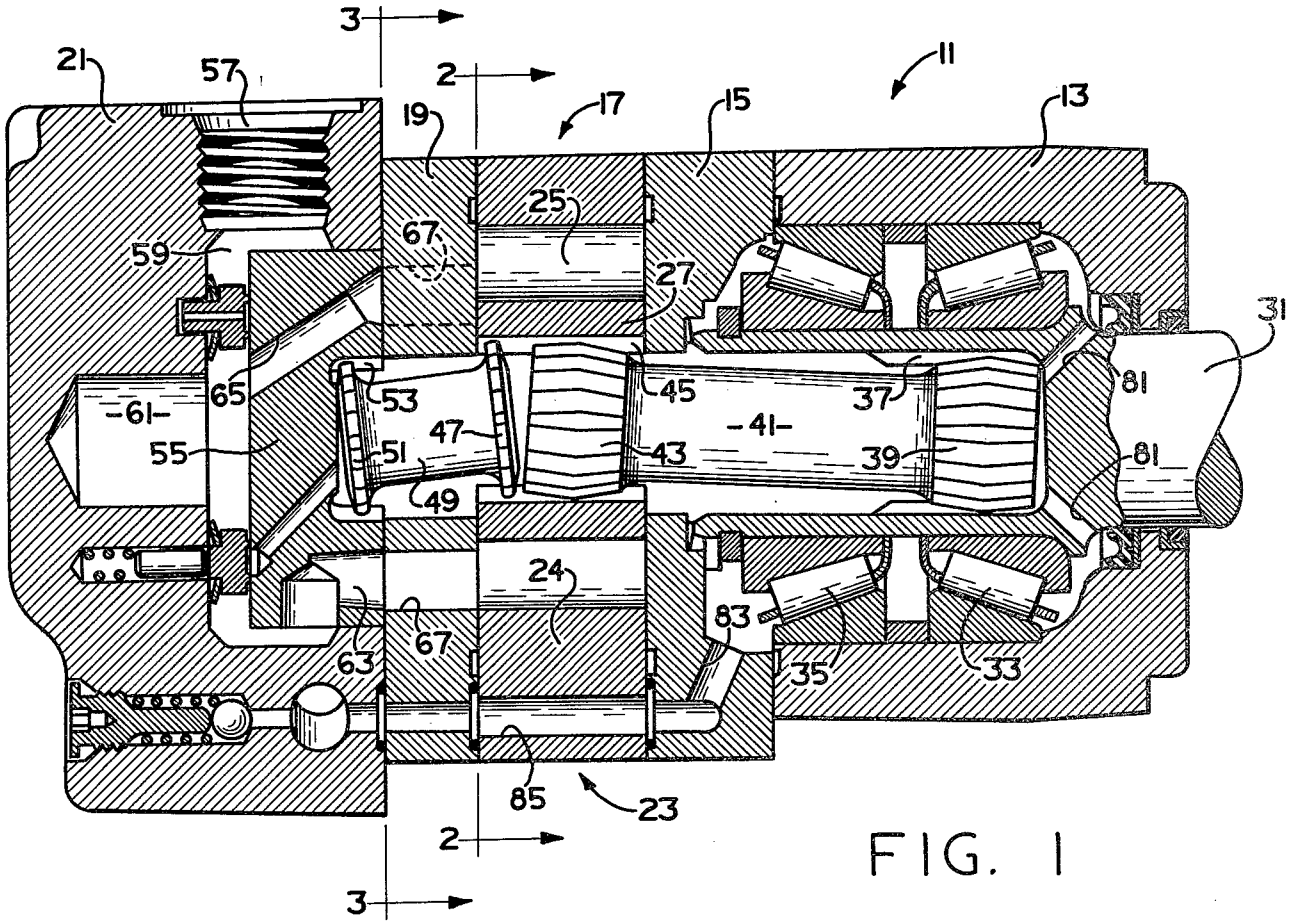
FIG. 1 is an axial cross section of a fluid motor of the type in which the present invention is preferably utilized.

Referring now to the drawings, which are not intended to limit the invention, FIG. 1 is an axial cross section of a fluid pressure actuated motor of the type to which the present invention may be applied, and which is illustrated and described in greater detail in U.S. Pat. No. 3,572,983, assigned to the assignee of the present invention. It should be understood that the term "motor" when applied to such fluid pressure devices is also intended to encompass the use of such devices as pumps.

Figure 2:
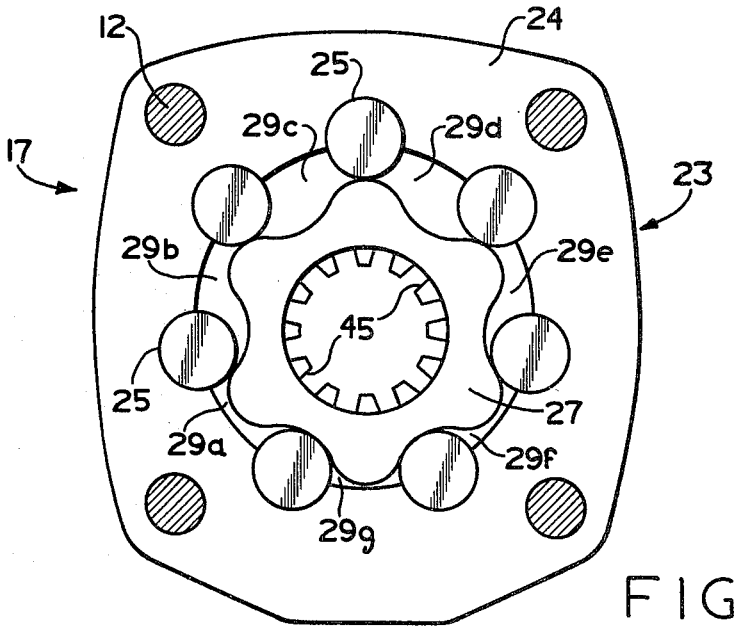
FIGS. 2 and 3 are transverse cross sections taken on line 2—2 and 3—3 of FIG. 1, respectively.
Figure 3:
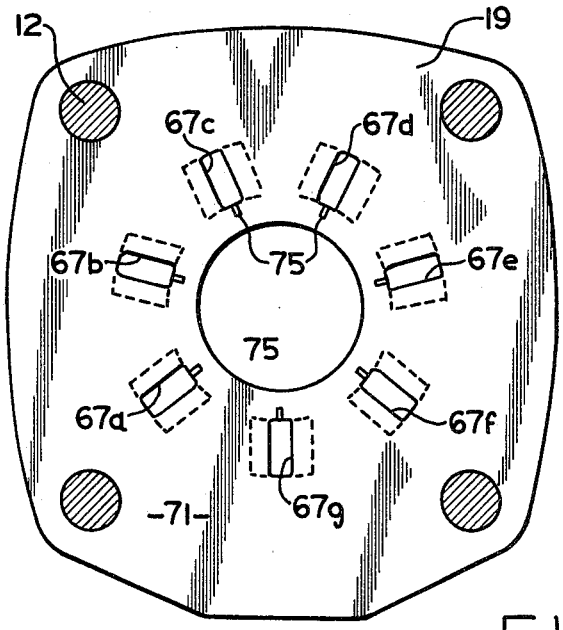

The hydraulic motor, generally designated 11, comprises a plurality of sections secured together, such as by a plurality of bolts 12 (shown only in FIGS. 2 and 3). The motor 11 includes a shaft support casing 13, a wear plate 15, a gerotor displacement mechanism 17, a port plate 19, and a valve housing portion 21.

The gerotor displacement mechanism 17 is well known in the art and will be described only briefly herein. More specifically, in the subject embodiment, the displacement mechanism 17 is a Geroler displacement mechanism comprising an internally-toothed assembly 23. The assembly 23 includes a stationary ring member 24 defining a plurality of generally semi-cylindrical openings, and rotatably disposed in each of the openings is a cylindrical member 25, as is now well known in the art. Eccentrically disposed within the internally-toothed assembly 23 is an externally-toothed rotor member 27, typically having one less external tooth than the number of cylindrical teeth 25, thus permitting the rotor member 27 to orbit and rotate relative to the internally-toothed assembly 23. The relative orbital and rotational movement between the assembly 23 and the rotor 27 defines a plurality of expanding and contracting volume chambers 29.

Referring still to FIG. 1, the motor 11 includes an input-output shaft 31 positioned within the shaft support casing 13 and rotatably supported therein by suitable bearing sets 33 and 35. The shaft 31 includes a set of internal, straight splines 37, and in engagement therewith is a set of external, crowned splines 39 formed on one end of a main drive shaft 41. Disposed at the opposite end of the main drive shaft 41 is another set of external, crowned splines 43, in engagement with a set of internal, straight spline 45, formed on the inside diameter of the externally-toothed rotor member 27. Therefore, in the subject embodiment, because the internally-toothed assembly 23 includes six internal teeth 25, seven orbits of the rotor member 27 result in one complete rotation thereof, and as a result, one complete rotation of the main drive shaft 41 and the input-output shaft 31.

Also in engagement with the internal splines 45 is a set of external splines 47 formed about one end of a valve drive shaft 49 which has, at its opposite end, another set of external splines 51 in engagement with a set of internal splines 53 formed about the inner periphery of a valve member 55. The valve member 55 is rotatably disposed within the valve housing 21, and the valve drive shaft 49 is splined to both the rotor member 27 and the valve member 55 in order to maintain proper valve timing, as is generally well known in the art.

The valve housing 21 includes a fluid port 57 in communication with an annular chamber 59 which surrounds the annular valve member 55. The valve housing 21 also includes another fluid port (not shown) which is in fluid communication with a fluid chamber 61. The valve member 55 defines a plurality of alternating valve passages 63 and 65, the valve passages 63 being in continuous fluid communication with the annular chamber 59, and the valve passages 65 being in continuous fluid communication with the chamber 61. In the subject embodiment, there are six of the valve passages 63, and six of the valve passages 65, corresponding to the six external teeth or lobes of the rotor member 27.

The port plate 19 defines a plurality of fluid passages 67, each of which is disposed to be in continuous fluid communication with the adjacent volume chamber 29. As may best be seen in FIG. 3, the cross sectional area of each of the fluid passages 67 is smallest adjacent the valve member 55 and largest adjacent the volume chamber 29. In operation, pressurized fluid entering the fluid port 57 will flow through the annular chamber 59, then through each of the valve passages 63, and through the fluid passages in the port plate 19 which are identified as **67*a*, 67*b*, and 67*c*. This fluid will then enter the expanding volume chambers identified as 29*a*, 29*b*, and 29*c*, respectively. The above-described flow of pressurized fluid will result in movement of the rotor member 27, as viewed in FIG. 2, comprising (a) orbiting movement in the counterclockwise direction, and (b) rotating movement in the clockwise direction. As is well known to those skilled in the art, the above-described flow will also result in clockwise rotation of the valve member 55 and output shaft 31, when viewed in the same direction as FIG. 2. However, the valve member 55** is shown rotating counterclockwise in FIG. 4, which is taken in a direction opposite that of FIG. 2.

At the given instant of operation illustrated in FIG. 2, fluid exhausted from the contracting volume chambers **29*d*, 29*e*, and 29*f* is communicated through the fluid passages 67*d*, 67*e*, and 67*f*, respectively. Exhaust fluid flowing out of the fluid passages 67 enters the respective valve passages 65 and flows into the fluid chamber 61, then to the fluid port not shown in FIG. 1**, and from there, to the reservoir. The operation of the fluid motor described above is conventional, and generally well understood by those skilled in the art.

Figure 4:
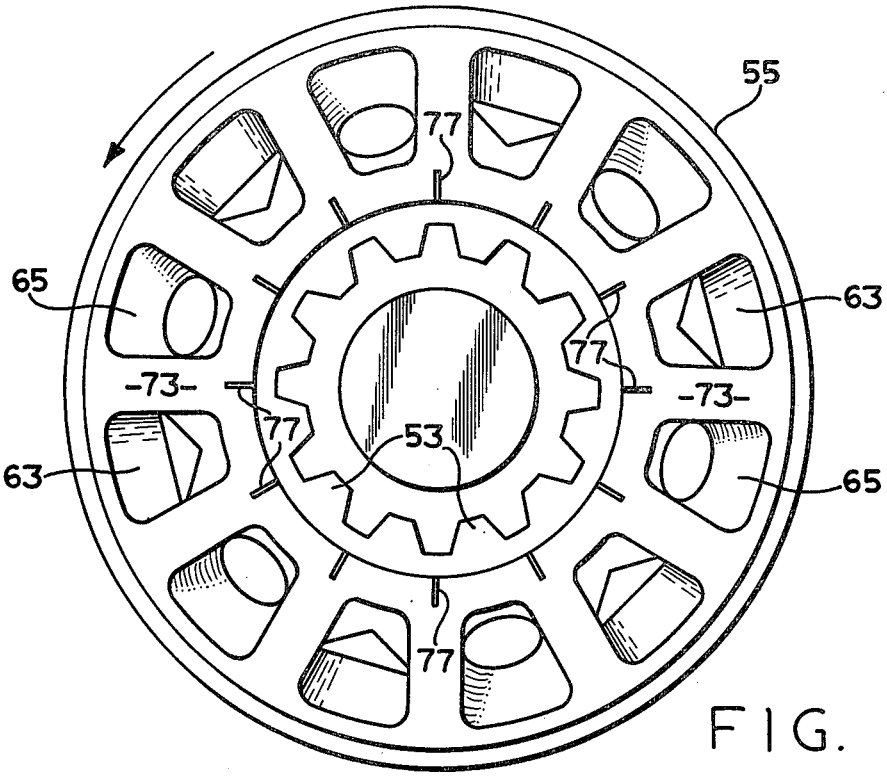
FIG. 4 is a front elevation of the rotatable valve member shown in FIG. 1, viewed in a direction opposite that of FIGS. 2 and 3, and on a scale twice that of FIGS. 1-3.

From the general description given above of the operation of the motor 11, it should be apparent that the valving action in the subject embodiment of the invention occurs between a valve surface 71 of the port plate 19 (FIG. 3) and a valve surface 73 of the valve member 55 (FIG. 4). In the subject embodiments, the valve surfaces 71 and 73 are flat, planar surfaces oriented substantially perpendicular to the axis of the motor 11. However, it is within the scope of the present invention for the valve surfaces to be cylindrical, as would be the case in a fluid motor of the type referred to as a "spool valve" motor, the general construction of which is illustrated in U.S. Pat. No. 3,606,598, assigned to the assignee of the present invention, and incorporated herein by reference. The application of the present invention to a spool valve motor will be illustrated and described subsequently.

Figure 5:
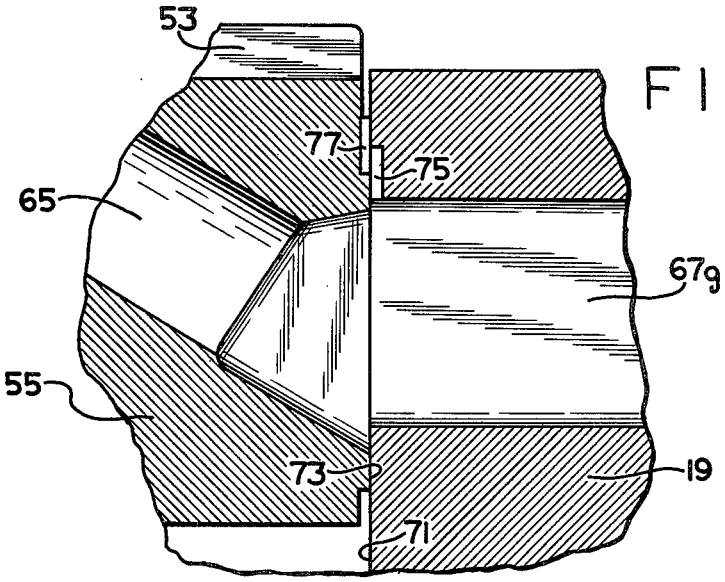
FIG. 5 is a fragmentary view, similar to FIG. 1, but with the valve member in a different position, and on a scale four times that of FIGS. 1-3.

Referring now primarily to FIGS. 3, 4, and 5, the structure of the present invention will be described in some detail. The valve surface 71 of the port plate 19 defines a plurality of secondary fluid passages 75, each of which is in open fluid communication with its adjacent fluid passage 67, and extends radially inwardly therefrom. Similarly, the valve surface 73 of the valve member 55 defines a plurality of secondary fluid passages 77, each of which is preferably disposed between an adjacent fluid passage 63 and an adjacent fluid passage 65. Each of the fluid passages 77 is in fluid communication with a central, open region of the motor 11 within which is disposed the valve drive shaft 49, and extends radially outwardly from this central, open region. Referring now to FIG. 5, which illustrates the flow path established by the fluid passages 75 and 77, it should be noted that the cross section shown in FIG. 5 is not strictly correct, but is intended to illustrate relative positions of various elements. More specifically, it will be noted by viewing FIG. 4 that none of the fluid passages 77 would actually appear in the same cross section with one of the fluid passages 65, or with one of the fluid passages 63. However, in view of the fact that the valve member 55 is shown on a larger scale in FIG. 4 than is the port plate 19 in FIG. 3, the cross section in FIG. 5 is intended to illustrate, in one view, the relative positions of the fluid passages 65 (or 63) and 67 during communication, as well as to illustrate the "secondary" fluid path provided by the fluid passages 75 and 77.

As was mentioned generally in the background of the present specification, there are believed to be two primary potential sources of noise in devices such as the motor 11. These will be described in more detail, and with reference primarily to FIGS. 2 and 6–8. In FIG. 2, it may be seen that the rotor member 27 is in such a position that the volume chamber **29*g* is at its "minimum volume position". The position of the displacement mechanism 17 shown in FIG. 2 corresponds to the relative position of the valve surfaces 71 and 73 illustrated in FIG. 7. As was described previously, with the displacement mechanism 17 in the position shown in FIG. 2, the fluid passages 67*a*, 67*b*, and 67*c* are receiving pressurized fluid through the respective valve passages 63, while exhaust fluid is being communicated from the fluid passages 67*d*, 67*e*, and 67*f* to the respective valve passages 65. At the same time, because the volume chamber 29*g* is at its minimum volume position, the fluid passage 67*g* is blocked from communication with either the adjacent valve passage 63 or the adjacent valve passage 65. It will be understood by those skilled in the art that the relative positions and spacings of the passages 63 and 65 shown in FIGS. 6–8** are intended primarily to illustrate the concept of the present invention, and are not intended to accurately represent the valve timing.

Referring again to the primary, potential sources of noise, it may be seen that, an instant before the volume chamber **29*g* reaches its minimum volume position, i.e., while it is still contracting, the valve member 55 rotates to such a position that the flow of exhaust fluid from the passage 67*g* to the valve passage 65 is blocked. Therefore, exhaust fluid still in the volume chamber 29*g* is trapped, and the slight, additional decrease in the size of the volume chamber 29*g* as it reaches the position shown in FIG. 2 results in a pressure surge within the volume chamber 29*g*. It is believed that such a pressure surge is effective, especially at relatively higher pressure differentials, to bias the rotor member 27 (upward in FIG. 2) into engagement with the cylindrical teeth 25 at the top of the internally-toothed assembly 23. The above-described movement of the rotor member 27 is, of course, quite small in magnitude, but the resulting contact of the rotor member 27 with the opposite teeth 25 is believed to be sufficient to produce a very noticeable and undesirable noise level. The occurrence of the phenomenon hypothesized above has been indicated by the observation of a series of flats on the teeth of the rotor member 27**.

Figure 8:
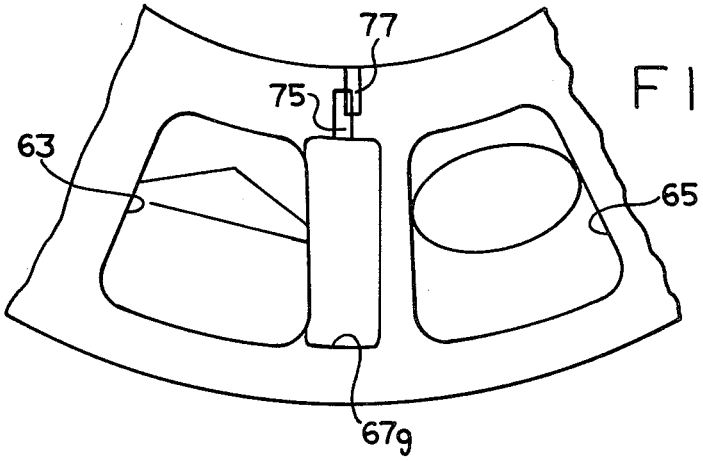
Figure 9:
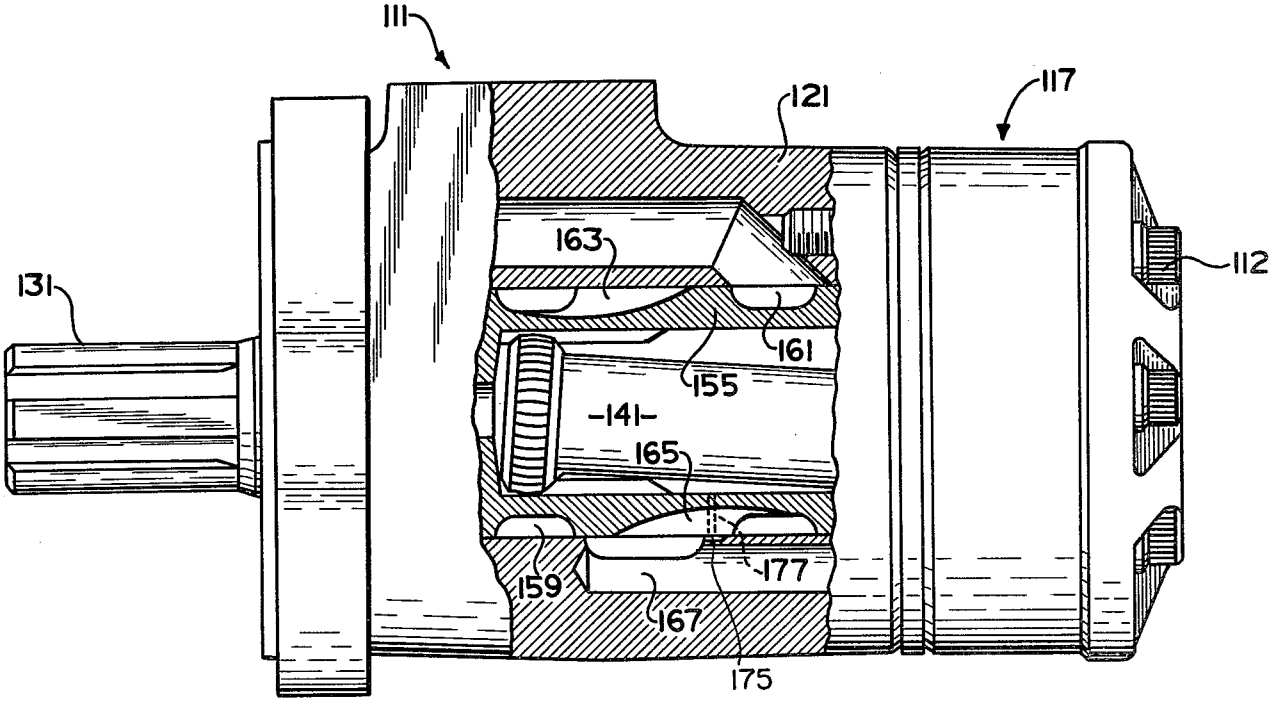
FIG. 9 is a view partly in axial cross section, and partly in elevation, illustrating a different embodiment of a fluid motor of the type to which the present invention may be applied.
Figure 10:
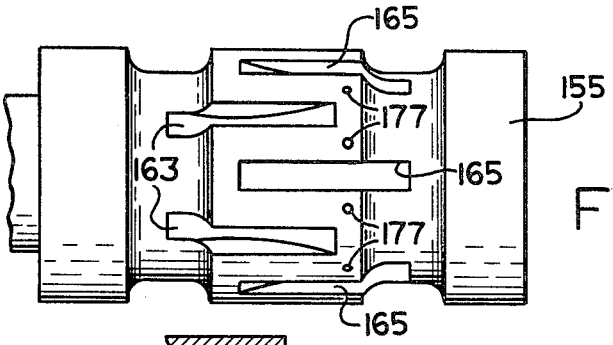
FIG. 10 is a partly broken away elevation of the rotatable valve member of the fluid motor shown in FIG. 9.
Figure 11:
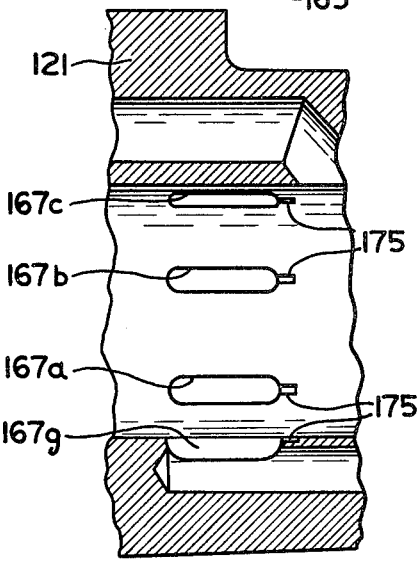
FIG. 11 is a fragmentary axial cross section, similar to FIG. 9, but with the rotatable valve member removed to expose a portion of the internal, cylindrical valve surface defined by the housing.

The other potential source of noise is believed to occur just after the volume chamber **29*g* passes its minimum volume position, and the valving approaches the position shown in FIG. 8. At this point in time, with fluid communication between the fluid passage 67*g* and the valve passage 63 still blocked, and the volume chamber 29*g* increasing in volume, it is hypothesized that cavitation occurs in the volume chamber 29*g*. The phenomenon of cavitation is generally well understood in the art and will not be described in great detail herein. It is believed that, when the valving reaches the position shown in FIG. 8, pressurized fluid flowing from the valve passage 63, through the fluid passage 67*g* and into the volume chamber 29*g*** which is now expanding, comes into contact with the vapor bubbles formed as a result of the cavitation described previously. The result is collapse of the vapor bubbles, again producing a substantial amount of undesirable noise.

Figure 6:
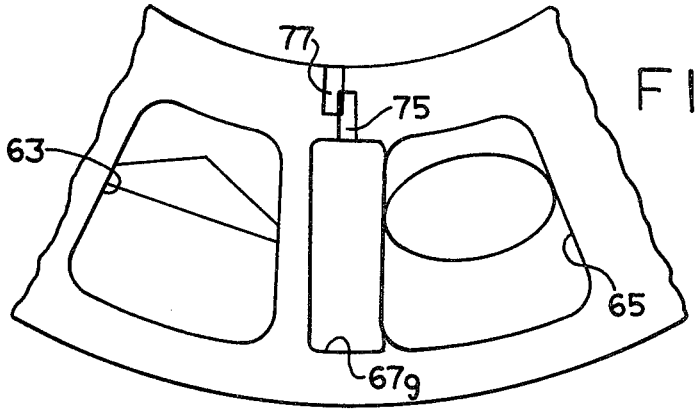
FIGS. 6, 7, and 8 are somewhat schematic views illustrating the engaging valve surfaces at three different rotational positions of the valve member, and illustrating the operation of the present invention.
Figure 7:
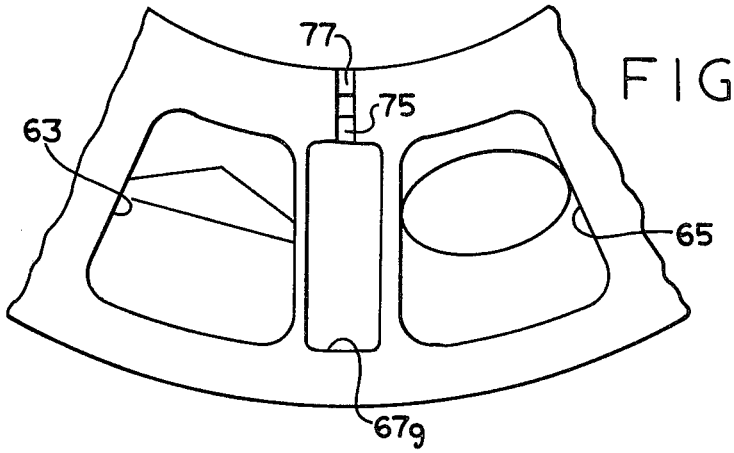

Referring still primarily to FIGS. 6, 7, and 8, the operation of the present invention will now be described. As may best be seen in FIG. 6, just as the valve member 55 rotates to such a position that the flow of exhaust fluid from the fluid passage **67*g* to the valve passage 65 is blocked, the secondary fluid passage 77 begins to communicate with the secondary fluid passage 75. The result is that, instead of fluid being trapped in the contracting volume chamber 29*g*, by the time the volume chamber 29*g* reaches its minimum volume position, the flow area between the secondary fluid passages 75 and 77 is sufficient to communicate fluid which otherwise would be trapped, and permit it to flow into the central region defined by the port plate 19. It will be appreciated that the flow area provided between the secondary fluid passages 75 and 77** is very small, such that the actual quantity of fluid flowing therethrough is quite small, but at the same time, is sufficient to prevent the occurrence of a pressure surge as described previously.

As may best be seen in FIG. 8, just after the volume chamber 29*g* passes its minimum volume position, and begins to increase in volume, instead of the fluid passage 67*g* (and the volume chamber 29*g*) being blocked and unable to receive fluid (which would result in cavitation), fluid is drawn back through the secondary fluid passages 75 and 77, and through the fluid passage 67*g* into the expanding volume chamber 29*g*. This is able to occur until the valve member 55 rotates to a position in which the fluid passage 67*g* begins to communicate with the valve passage 63, and is able to receive pressurized fluid therefrom.

The fluid drawn through the secondary passages 75 and 77 by the expanding volume chamber 29*g* as described above is basically the same fluid which, during the previous instant, had been exhausted to prevent the pressure surge as the volume chamber 29*g* completed its contraction. In the subject embodiment, the secondary fluid passages 75 and 77 have been described as providing fluid communication between the fluid passage 67*g* and the central, open region of the port plate 19 which, as is shown in FIG. 1 and as is well known in the art, is in fluid communication with the region in which the main drive shaft 41 is located. This entire central region communicates through a pair of angled passages 81, defined by the output shaft 31, with the region in which the bearing sets 33 and 35 are disposed. This region, in turn, communicates through an angled passage 83 to a case drain passages 85, which may be connected to the low pressure, outlet port of the motor 11, or may be connected to an external case drain fitting, as is well known in the art. Thus, it is one aspect of the present invention that each of the secondary fluid passages 77 should be in fluid communication with a source of relatively lower pressure fluid, and in the devices of the type to which the present invention would be applied, the case drain "circuit" is available as such a source. As used herein the term "source of relatively lower pressure fluid" is not intended to indicate any particular pressure level, but merely that the invention is better able to relieve pressure surges when the fluid passages 77 are connected to a source of fluid at a pressure low enough to provide a substantial pressure differential across the secondary passages 75 and 77. Although the operation of the present invention has been described with respect to the operating condition wherein the volume chamber 29*g* is approaching its minimum volume condition, it should be clearly understood that during one complete orbit of the rotor member 27, each of the volume chambers 29*a* through 29*g* goes through the same cycle of contracting, reaching its minimum volume position, then expanding as was described for the volume chamber 29*g*. Thus, during one complete orbit of the rotor member 27, each of the fluid passages 75 is permitted to communicate with its respective fluid passage 77. In accordance with the present invention, this permitted communication occurs as each volume chamber is at approximately its minimum volume position, and fluid communication is blocked between the respective fluid passage 67, and both of the adjacent valve passages 63 and 65, as has been described above. Furthermore, it should be understood that as the rotor member 27 orbits, it also rotates, such that during each complete orbital movement of the member 27, each of the fluid passages 75 will communicate with a different one of the fluid passages 77, until after six complete orbits of the rotor member 27, and one complete rotation thereof, the valve member 55 has also made one complete rotation, and each of the fluid passages 75 again communicates with the same one of the fluid passages 77, in much the same manner that each of the valve passages 63 and 65 again communicates with the same one of the fluid passages 67.

In describing the operation of the present invention, consideration has been given only to the condition of each of the volume chambers as it approaches the minimum volume position. If that were the sole function of the present invention, only six of the fluid passages 77 would be required in the subject embodiment. However, it may be seen in FIG. 4 that there are 12 of the fluid passages 77, corresponding to twice the number of external teeth on the rotor member 27. Although not an essential feature of the present invention, the additional fluid passages 77 make it possible for the preferred embodiment of the invention to perform a similar function, as each of the volume chambers approaches the maximum volume position. However, as understood by those skilled in the art, the problems which occur (i.e., trapping and cavitation) occur in the reverse order when the volume chamber is at the maximum volume position. If the volume chamber expands after the fluid passage 67 is blocked from communication with the valve passage 63, cavitation can occur within the volume chamber, and secondly, if the volume chamber begins to contract before there is fluid communication established between the fluid passage 67 and the valve passage 65, trapping of fluid within the volume chamber can occur. It should also be noted that the problems of cavitation and trapping when the volume chambers are at the maximum position are not normally as serious as when the volume chambers are at the minimum volume position, primarily because, when the volume chamber is at its maximum volume position, the rate of change of volume of the chamber is less than when the volume chamber is at its minimum volume position.

Referring again to FIG. 2, it will be understood that with the displacement mechanism 17 in the position shown, none of the volume chambers is at its maximum volume position. However, upon a slight additional amount of orbiting movement of the rotor member 27, the volume chamber 29*c* will reach its maximum volume position. When this condition occurs, the secondary fluid passage 75 which is adjacent the fluid passage 67*c* will be in fluid communication with the respective secondary fluid passage 77, and the resulting operation will be substantially as described previously.

Referring now to FIGS. 9 through 13, an alternative embodiment will be described in which the present invention is being utilized in a spool valve motor and in which functionally equivalent elements bear the same numerals as in FIGS. 1 through 8, plus 100. It may be seen by viewing FIGS. 10, 12, and 13 that the primary difference between this embodiment of the invention and the embodiment shown in FIGS. 1 through 8 is that the fluid passages 177 comprise drilled holes extending radially from the outer surface of the rotatable valve member 155 into the interior of the hollow valve member 155, which is analogous to the central, open region defined by the port plate 19 in the first embodiment.

Figure 12:
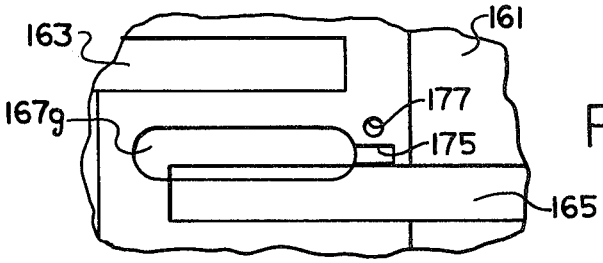
FIGS. 12 and 13 are somewhat schematic views of the engaging valve surfaces, illustrating the operation of the alternative embodiment of the present invention.
Figure 13:
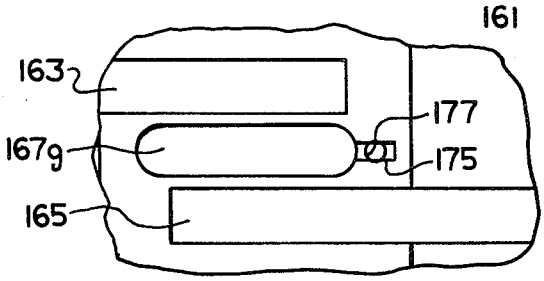

In considering the operation of this embodiment of the invention, it should be noted that FIG. 12 corresponds approximately to FIG. 6, i.e., it illustrates the condition in which the volume chamber 129*g* (not shown) is contracting, and exhaust fluid is flowing out of the fluid passage 167*g*, through the valve passage 165, and into the annular chamber 161. FIG. 13 corresponds approximately to FIG. 7, i.e., it illustrates the condition in which the volume chamber 129*g* is at its minimum volume position, the fluid passage 167 is no longer in fluid communication with the valve passage 165, and is not yet in fluid communication with the valve passage 163. The fluid passage 177 has moved into fluid communication with the fluid passage 175 to relieve any pressure surges resulting from the final contraction of the volume chamber 129*g*.

Therefore, whether the mating valve surfaces are flat, planar surfaces oriented substantially perpendicular to the axis of the device, or are cylindrical surfaces oriented substantially parallel to the axis of the device, it may be seen that the present invention may be used advantageously. The invention has been described in detail sufficient to enable one of ordinary skill in the art to make and use the same. Other modifications and alterations of the preferred embodiments will occur to those skilled in the art upon a reading and understanding of the specification, and it is my intention to include all such modifications and alterations as part of my invention, insofar as they come within the scope of the appended claims.

What is claimed is:

1. A rotary fluid pressure device comprising:

(a) housing means defining fluid inlet means and fluid outlet means;

(b) an internal gear set associated with said housing means and including an internally-toothed member, and an externally-toothed member eccentrically disposed within said externally-toothed member for relative movement therebetween, the teeth of said members interengaging to define expanding and contracting volume chambers during said relative movement, one of said members having rotational movement about its own axis and one of said members having orbital movement about the axis of the other of said members;

(c) first and second relatively movable valve elements having respective first and second slidably engaging valve surfaces, one of said valve elements being movable in synchronism with one of said movements of one of said toothed members, said first valve element defining a plurality N of fluid passages in fluid communication with said expanding and contracting volume chambers and having passage openings in said first valve surface arranged circumferentially relative to the axis thereof, said second valve element defining a plurality of valve ports having openings in said second valve surface arranged circumferentially relative to the axis thereof, said plurality of valve ports including a first group of valve ports having constant fluid communication with said fluid inlet means, and a second group of valve ports having constant fluid communication with said fluid outlet means, at least a portion of said first valve element passage openings being in fluid communication with at least a portion of said second valve element port openings during said relative movement to direct fluid from said fluid inlet means to said expanding volume chambers, and to direct fluid from said contracting volume chambers to said fluid outlet means; and (d) secondary valve means associated with at least one of said first and second valve elements and being operable to permit fluid communication between each of said volume chambers and a source of relatively lower pressure fluid, said permitted communication occurring as each volume chamber is at approximately its minimum volume position and fluid communication is blocked between the respective first valve element passage opening and both of the adjacent second valve element port openings.

2. A rotary fluid pressure device as claimed in claim 1 wherein said secondary valve means is operable to permit fluid communication between each of said volume chambers and said source of relatively lower pressure fluid as each volume chamber is at approximately its maximum volume position and fluid communication is blocked between the respective first valve element passage opening and both of the adjacent second valve element port openings.

3. A rotary fluid pressure device as claimed in claim 1 wherein said secondary valve means includes said fluid passages defined by said first valve element.

4. A rotary fluid pressure device as claimed in claim 3 wherein the valving action of said secondary valve means occurs at said first and second valve surfaces, and said source of relatively lower pressure fluid comprises case drain pressure.

5. A rotary fluid pressure device as claimed in claim 3 wherein said secondary valve means further includes a first plurality N of secondary fluid passages defined by said first valve element, each of said secondary fluid passages being in fluid communication with one of said first valve element passage openings, and a second plurality of secondary fluid passages defined by said second valve element, each of said second plurality of secondary fluid passages being in fluid communication with said source of relatively lower pressure fluid.

6. A rotary fluid pressure device as claimed in claim 5 wherein said second valve element rotates relative to said first valve element, and during said relative rotation, each of said second plurality of secondary fluid passages communicates sequentially with each of said first plurality of secondary fluid passages as each of said respective volume chambers arrives at its minimum volume position.

7. A rotary fluid pressure device as claimed in claim 6 wherein each of said second plurality of secondary fluid passages communicates sequentially with each of said first plurality of secondary fluid passages as each of said respective volume chambers arrives at its maximum volume position.

8. A rotary fluid pressure device as claimed in claim 5 wherein said first and second valve surfaces are flat, planar surfaces oriented substantially perpendicular to the axis of said device.

9. A rotary fluid pressure device as claimed in claim 8 wherein each of said first plurality of secondary fluid passages is defined by said first valve surface, communicates with a respective first valve element passage opening, and extends radially inwardly from said respective passage opening.

10. A rotary fluid pressure device as claimed in claim 9 wherein said second valve element defines a central region in fluid communication with said source of relatively lower fluid pressure, and each of said second plurality of secondary fluid passages is defined by said second valve surface, communicates with said central region, and extends radially outwardly therefrom a sufficient distance to communicate with said first plurality of secondary fluid passages.

* * * * *